US006536937B1

(12) United States Patent
Burchett

(10) Patent No.: US 6,536,937 B1
(45) Date of Patent: Mar. 25, 2003

(54) SELF-CONTAINED BASE FOR A SURGICAL CEMENT MIXING SYSTEM, BINDING MATERIAL MIXING BASE, AND SURGICAL BONE CEMENT MIXING SYSTEM

(75) Inventor: Ronnie Burchett, Missoula, MT (US)

(73) Assignee: Telios Orthopedic Systems, Inc., Missoula, MT (US)

( * ) Notice: Subject to any disclaimer, the term of this patent is extended or adjusted under 35 U.S.C. 154(b) by 0 days.

(21) Appl. No.: 09/503,946

(22) Filed: Feb. 14, 2000

(51) Int. Cl.[7] ..... B01F 13/06
(52) U.S. Cl. ..... 366/139; 366/247
(58) Field of Search ..... 366/139, 189, 366/244, 245, 247–254; 494/61

(56) References Cited

U.S. PATENT DOCUMENTS 3,567,113 A * 3/1971 Stansell et al.
4,185,072 A * 1/1980 Puderbaugh et al. ..... 422/99
4,764,162 A * 8/1988 Romanauskas ..... 494/38
4,787,751 A * 11/1988 Bakels ..... 366/110
5,265,956 A 11/1993 Nelson et al. ..... 366/139
5,344,232 A 9/1994 Nelson et al. ..... 366/139
5,415,474 A 5/1995 Nelson et al. ..... 366/139
5,545,460 A 8/1996 Tanaka et al. ..... 428/137
5,558,136 A 9/1996 Orrico ..... 141/23
5,588,745 A 12/1996 Tanaka et al. ..... 366/130
5,797,679 A 8/1998 Grulke et al. ..... 366/139
5,842,785 A 12/1998 Brown et al. ..... 366/139
5,975,751 A * 11/1999 Earle
6,017,349 A * 1/2000 Heller et al.

* cited by examiner

*Primary Examiner*—Charles E. Cooley
*Assistant Examiner*—David Sorkin
(74) *Attorney, Agent, or Firm*—Dorsey & Whitney LLP

(57) ABSTRACT

A base for a disposable surgical cement mixing system includes a support member and a vacuum source. The support member is configured to support cement within a mixing chamber. The vacuum source is carried by the support member. The vacuum source is operative to impart a relative vacuum within the mixing container during mixing of the cement.

33 Claims, 4 Drawing Sheets

SELF-CONTAINED BASE FOR A SURGICAL CEMENT MIXING SYSTEM, BINDING MATERIAL MIXING BASE, AND SURGICAL BONE CEMENT MIXING SYSTEM

TECHNICAL FIELD

This invention pertains to surgical cement mixing and delivery systems. More particularly, this invention relates to a self-evacuating base unit for a surgical bone cement mixing and delivery system.

BACKGROUND OF THE INVENTION

There exist a number of applications where it is required to efficiently and thoroughly mix a binding material such as an adhesive or a cement that is formed from multiple components. For such applications, it is desirable to minimize the presence of air bubbles introduced within the adhesive during the mixing process. In many cases, the presence of air bubbles in the adhesive can weaken the resulting material that is formed by curing the adhesive.

One application is in the field of orthopedic surgery where an adhesive, in the form of surgical bone cement, is frequently used. Surgical bone cement typically comprises a two-part monomer polymer, such as methyl methacrylate. The use of surgical bone cement when performing orthopedic surgery has long been known. Numerous surgical procedures require the use of surgical bone cement. One exemplary procedure involves the installation of an artificial hip joint into a patient where the superior end of the patient's femur is removed, and surgical bone cement is delivered into the resulting femoral cavity, prior to inserting a stem of the implant into the femoral canal. Additionally, another known procedure involves packing surgical bone cement around an implant component, such as when performing an acetabular construction by securing an acetabular cup of a hip joint replacement system into a hip socket using surgical bone cement.

In most orthopedic applications where surgical bone cement is used, time is of the essence when mixing and delivering surgical bone cement because such cement is formed from at least two components which are mixed together, and which generate heat when mixed so as to initiate imminent curing and hardening of the cement. However, such process occurs relatively quickly, which means that mixing and delivery tools must operate efficiently so that the bone cement does not cure before a surgeon is able to deliver the cement to a desired surgical site.

Stationary surgical cement mixing apparatus are known. Such apparatus form automated mixing stations that are relatively large and relatively immovable. For example, computer-controlled apparatus are known in the art for performing mixing and applying a vacuum within a mixing chamber. However, such surgical cement mixing apparatus are not portable, lightweight, and of relatively low-cost construction. Furthermore, such surgical cement mixing apparatus cannot be hermetically sealed and pre-packaged for disposable, single use within a surgical operating environment. Instead, such apparatus must be cleaned after each use, and can only be sterilized by autoclaving the apparatus. Furthermore, the apparatus cannot be readily moved from one desired location to another desired location.

U.S. Pat. No. 5,797,679 discloses one disposable surgical cement mixer apparatus having a base containing vacuum nipples that communicate with one another and that protrude from the base on opposite sides. One nipple is connected to a conventional vacuum source that is provided externally of the cement mixer apparatus. The other nipple is connected via a piece of plastic tubing with a cement mixing chamber of the mixer apparatus. In this way, a sub-atmospheric pressure can be applied within the mixing chamber during a mixing operation. However, such mixer apparatus requires the use of a conventional vacuum source which is located externally and separate from the apparatus. Accordingly, it becomes necessary to use the mixer apparatus in close proximity with an external vacuum source. Such proximity requirement significantly limits the mobility of the mixer apparatus. Additionally, it is necessary to connect a vacuum tube between the mixer apparatus and the external vacuum source. The presence of such tube during surgery is undesirable because the tubing restricts movement of the mixer apparatus within a surgical operating room. Furthermore, the tubing presents a hazard for personnel during such surgery resulting from potential entanglement of the tubing with personnel and equipment. Furthermore, since such mixer apparatus should be sterile, the act of physically connecting the mixer apparatus with an external vacuum source provides an opportunity for undesirable contamination.

SUMMARY OF THE INVENTION

A disposable support base and mixing system includes an improved apparatus for mixing binding materials such as adhesives and two-part cements, including acrylic surgical bone cement which is adapted to fix a surgical repair element to a patient's hard tissue or bone. The base of the mixing system includes a vacuum source which is self-contained within the base in order to facilitate unencumbered and portable use of the mixing system within a surgical operating environment, and further to ensure that the mixing system remains sterile during deployment and use within the surgical operating environment. Even furthermore, such base ensures unencumbered use as the vacuum source is self-contained within the base which enhances pre-packaging within a sterile package. Even further uses are potentially available for mixing adhesives, such as multiple-component epoxies, for use in other non-medical applications. All of the above features are provided in an apparatus and support base that is relatively small, portable, lightweight, disposable, and of relatively low-cost construction.

According to one aspect, a disposable base for a surgical cement mixing system includes a support member and a vacuum source. The support member is configured to support cement within a mixing chamber. The vacuum source is carried by the support member. The vacuum source is operative to impart a relative vacuum within the mixing container during mixing of the cement.

According to another aspect, a portable binding material mixing base includes a support base and a vacuum source. The support base includes a housing. The vacuum source is provided in the housing. The vacuum source is operative to impart a vacuum to a binding material during mixing.

According to yet another aspect, a portable surgical bone cement mixing system includes a hollow base, a mixing container, and a vacuum pump. A mixing container is supported by the base. The vacuum pump is carried within the base. Furthermore, the vacuum pump is configured to apply a relative vacuum within a mixing chamber of the mixing container.

BRIEF DESCRIPTION OF THE DRAWINGS

Preferred embodiments of the invention are described below with reference to the following accompanying drawings depicting examples embodying the best mode for practicing the invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

An apparatus is provided for supporting a binding material mixing system during a mixing operation. One construction is designed to mix surgical bone cement. The apparatus comprises a support base that includes a vacuum source for applying a vacuum during a mixing operation. Such apparatus is self-contained, portable, and disposable, which facilitates use in sterile environments and under conditions where time is of the essence when mixing a bone cement that cures in a relatively short period of time. Hence, any tendency to waste bone cement is reduced or eliminated.

Reference will now be made to a preferred embodiment of Applicant's invention. One exemplary implementation is described below and is depicted with reference to the drawings, showing two application environments for the invention. While the invention is described via a preferred embodiment, it is understood that the description is not intended to limit the invention to this embodiment, but is intended to cover alternatives, equivalents, and modifications such as are included within the scope of the appended claims.

In an effort to prevent obscuring the invention at hand, only details germane to implementing the invention will be described in great detail, with presently understood peripheral details being incorporated by reference, as needed, as being presently understood in the art.

Figure 1:
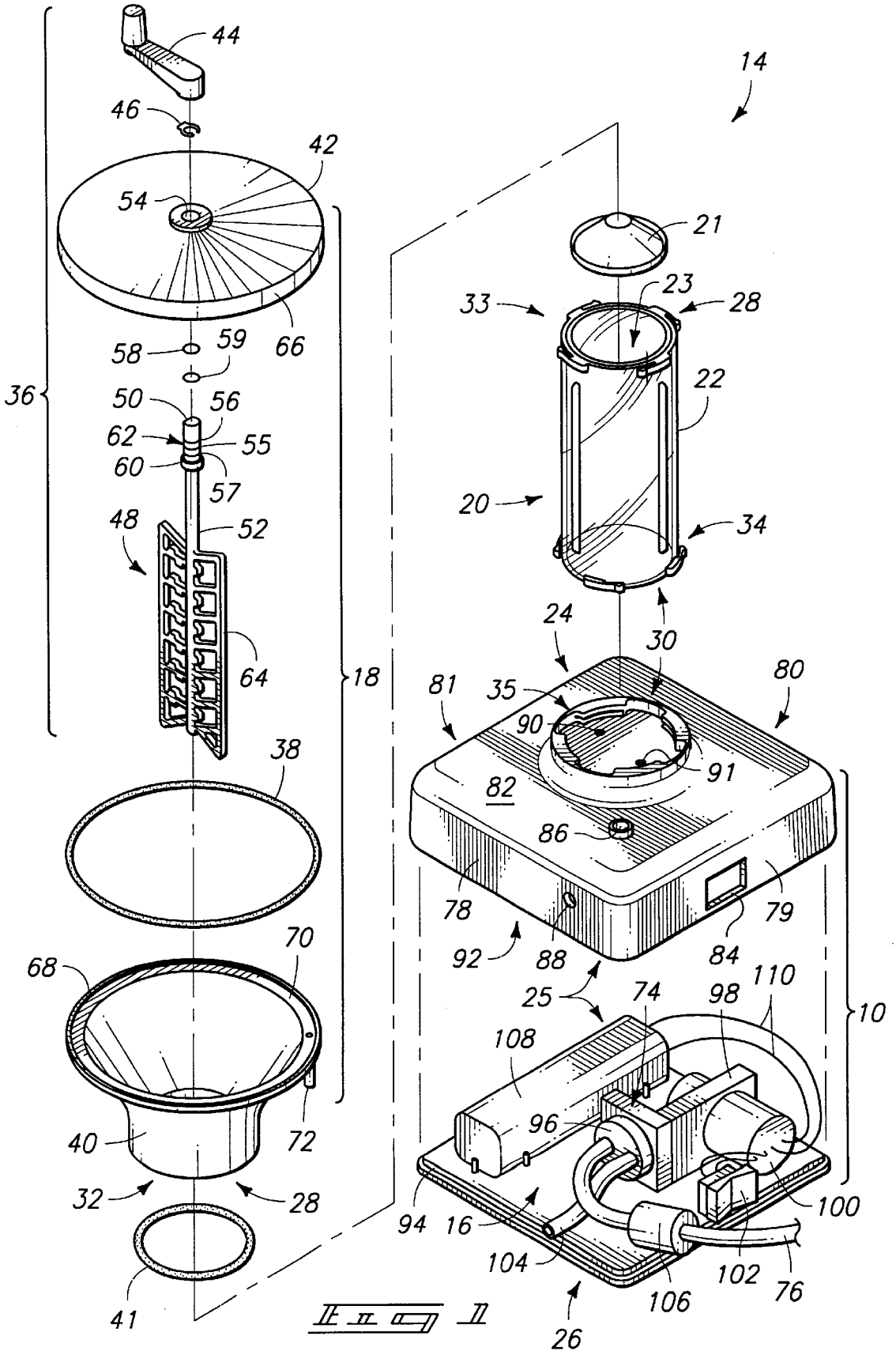
FIG. 1 is an exploded perspective view of a bone cement mixing apparatus using a self-contained and disposable support base and that forms part of an interchangeable bone cement mixing and delivery system according to one aspect of the invention.

FIG. 1 illustrates an exploded perspective view of a self-evacuating support base identified by reference numeral 10. Support base 10 is provided as part of a surgical bone cement mixing and delivery system (not shown) which, in one configuration, forms a surgical bone cement cartridge mixing apparatus, or mixer, 14. Mixing apparatus 14 comprises a cartridge mixing apparatus that has a construction that can benefit from the present invention because base 10 comprises a self-contained, disposable base that supports mixer 14 in an upright orientation during a mixing operation. Furthermore, base 10 provides a vacuum source 16 that is used to apply a vacuum to bone cement while the cement is being mixed. Because vacuum source 16 is disposed within base 10, mixing apparatus 14 is self-contained which facilitates disposable use and still, hermetically-sealed packaging.

Because vacuum source 16 is self-contained within base 10, mixing apparatus 14 provides a self-contained and portable mixing system that is easily moved, in an unencumbered manner, in a work environment such as a surgical operating room. Accordingly, the aforementioned prior art problems imparted by using an external vacuum source and tubing to connect a mixing apparatus with such vacuum source are overcome. Namely, there is no tubing present which might tangle with equipment present in a surgical operating room, or present a tripping hazard for surgical personnel present during an operating procedure. Furthermore, such a self-contained mixing apparatus 14 is capable of being hermetically sealed within a sterile package, which greatly reduces any risk of contamination prior to and during use.

Figure 3:
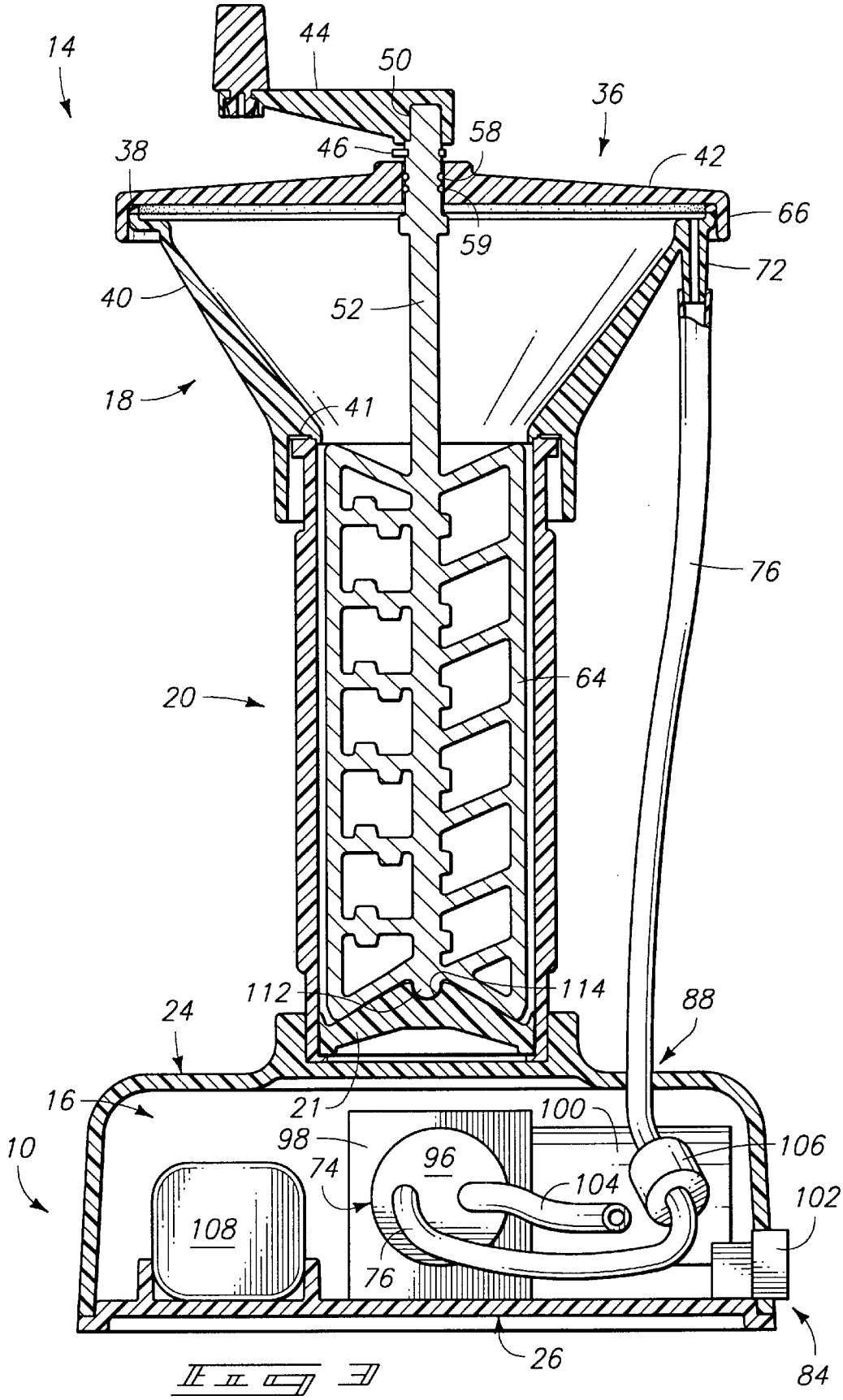
FIG. 3 is a vertical and centerline sectional view of the bone cement mixing apparatus of FIG. 2 showing the internal components of the disposable base and mixing apparatus.

As shown in FIG. 1, cartridge mixing apparatus 14 includes a funnel assembly 18, cartridge 20, piston 21, and support base 10. Cartridge 20 provides a container 22 for mixing bone cement. Funnel assembly 18, is removably mated in sealing engagement with a top end of cartridge 20 via a connector assembly 28. As shown in FIGS. 1 and 3, a resilient closed-cell foam gasket 41 is adhesively fastened within delivery funnel 40 and interposed, in assembly, between funnel 40 and cartridge 20 so as to form a seal therebetween. Similarly, a bottom end of cartridge 20 is removably mated in engagement with support base 10 via another connector assembly 30. Connector assemblies 28 and 30 comprise complementary mating connectors 32, 33 and 34, 35, respectively. Alternatively, container 22 can be integrally formed with base 10.

The particular construction of connector assemblies 28 and 30 is not critical to operation of the present invention. However, details of one construction, as depicted in FIG. 1, are described in Applicant's co-pending U.S. patent application Ser. No. 09/503,877, entitled "Connector Assembly for Mating Components, Connector Assembly for a Bone Cement Mixing and Delivery System, and Bone Cement Container Having a Connector Assembly", naming the inventor as Ronnie Burchett, filed concurrently herewith, and herein incorporated by reference.

Funnel assembly 18 includes a hand-driven, rotatable mixing blade assembly 36, a resilient closed-cell foam gasket 38, and a delivery funnel 40 for delivering bone cement ingredients into cartridge 20 where the ingredients are mixed together. Funnel 40 serves merely to deliver ingredients into cartridge 20 where the ingredients are mixed. Gasket 38 is adhesively bonded to cover 42 and forms a seal between a cover 42 of mixing blade assembly 36 and a topmost upturned edge 68 of delivery funnel 40. To facilitate delivery of bone cement ingredients into cartridge 20 prior to mixing, delivery funnel 40 has a frustoconical shape. According to one application, ingredients for a two-part bone cement, such as methyl methacrylate, are delivered into delivery funnel 40 and cartridge 20 after manually removing mixing blade assembly 36 from atop delivery funnel 40. According to another application, ingredients for a two-part epoxy adhesive are delivered into delivery funnel 40 and cartridge 20 for mixing therein.

Cover 42 includes a downwardly turned circumferential lip flange 66 that is received over upturned circumferential lip flange, or edge, 68 of delivery funnel 40. Lip flange 68 has a slightly smaller diameter than lip flange 66. A lowered circumferential shelf forms a gap between cover 42 and delivery funnel 40 such that a vacuum port 72 communicates with an interior of delivery funnel 40. Shelf 70 is provided radially inwardly of flange 68. Gasket 38 is engaged between cover 42 and flange 68. Gasket 38 is sized to have sufficient thickness so as to be urged into compressive and sealed engagement circumferentially around and between cover 42 and flange 68 of funnel 40. Gasket 38 is compressed when a vacuum is applied inside funnel 40 via a vacuum port 72 and a vacuum source 16 including a vacuum pump assembly 74 that is self-contained within support base 10.

Mixing blade assembly 36 includes cover 42, which remains stationary atop delivery funnel 40 during use, a drive handle 44, an E-spring metal retainer clip 46, and a mixing blade arm 48. Drive handle 44 is received in interfitting, mating engagement over a keyed stud 50 on a central shaft 52 of mixing blade arm 48. According to one construction, keyed stud 50 comprises a cylindrical stud into which a flat surface is formed, extending parallel to the axis of the stud. A complementary surface is formed within an aperture of handle 44 such that handle 44 and blade arm 48 mate together in assembly in interlocking relation. Accordingly, drive handle 44 and mixing blade arm 48 are rigidly secured together for rotation relative to cover 42, delivery funnel 40, and cartridge 20. Handle 44 can be further adhesively bonded to stud 50.

Mixing blade arm 48 includes central shaft 52, stud 50, bearing surface 62, circumferential shoulder 60, circumferential groove 56, and blade 64. According to one construction, mixing blade arm 48 is formed from a single piece of molded plastic material. A pair of neighboring synthetic rubber O-rings 58 and 59 are carried within circumferential grooves 55 and 57, respectively, provided in bearing surface 62. O-rings 58 and 59 form a rotary seal between shaft 52 and an aperture 54 of cover 42, with aperture 54 forming a substantially complementary bearing surface that is received against bearing surface 62. Accordingly, the transmission of air via aperture 54 into delivery funnel 40 and cartridge 20 is minimized when a vacuum is applied and when rotating blade 64 relative to cover 42 via drive handle 44. Such feature is important because support base 10 is operative to apply a vacuum inside of delivery funnel 40 and cartridge 20 during mixing of surgical bone cement therein. More particularly, a vacuum port 72 extends from inside funnel 40 to the outside of funnel 40 where a vacuum hose 76 communicating with vacuum source 16 attaches thereto (see FIGS. 2 and 3).

Cartridge 20 comprises a container 22 which is configured for mixing surgical bone cement when used in mixing apparatus 14. Additionally, cartridge 20 comprises a container 22 which is configured for storing and dispensing, or delivering, surgical bone cement when used in a bone cement delivery apparatus (not shown). Details of one bone cement delivery apparatus are disclosed in Applicant's co-pending U.S. patent application Ser. No. 09/503,947, entitled "Delivery Apparatus, Nozzle, and Removable Tip Assembly", naming inventors as Ronnie Burchett and Randy Scot Wills, filed concurrently herewith and incorporated herein by reference, as well as co-pending U.S. patent application Ser. No. 09/503,877, entitled "Connector Assembly for Mating Components, Connector Assembly for a Bone Cement Mixing and Delivery System, and Bone Cement Container Having a Connector Assembly", naming the inventor as Ronnie Burchett, and previously incorporated by reference.

Cartridge 20 includes a cylindrical, generally puck-shaped piston 21 having a cylindrical outer wall forming a leading edge feather seal which mates in sliding and sealing engagement with an inner wall of cartridge 20. Piston 21 is slid to the bottom of cartridge 20 prior to connecting cartridge 20 with base 10. Blade 64 of mixing blade assembly 36 is received in mating engagement with piston 21 during a mixing operation, as shown and described below in greater detail with reference to FIG. 3. After mixing cement within cartridge 20, mixing blade assembly 36 is removed from funnel 40 and cartridge 20, after which cartridge 20 is removed from base 10 and is further connected with components that cooperate to form a cement gun, with piston 21 being urged upwardly within cartridge 20 so as to deliver the mixed cement from the gun to a patient.

Accordingly, piston 21 forms a seal along a bottom of cartridge 20 so as to cooperate and define a mixing chamber 23 within cartridge 20. When a vacuum is applied via vacuum source 16, blade 64 retains piston 21 at the bottom of cartridge 20. Additionally, a topmost edge of cartridge 20 substantially seals with delivery funnel 40 when funnel 40 is received atop cartridge 20 via connector assembly 28.

As shown in FIG. 1, support base 10 contains vacuum source 16 which is enclosed within a housing 25 that includes a housing member 24 and a base plate 26. Housing member 24 is molded so as form side walls 78–81 and top wall 82. Connector 35 and vacuum tube aperture 86 are integrally molded within top wall 82. Vent aperture 88 is molded into side wall 78, while switch aperture 84 is molded into side wall 79. Additionally, a pair of apertures 90 and 91 are integrally molded into connector 35. Apertures 90 and 91 enable relatively permanent securement of a mixing bowl via threaded fasteners on top of support base 10, according to an optional embodiment depicted in FIG. 4.

Figure 2:
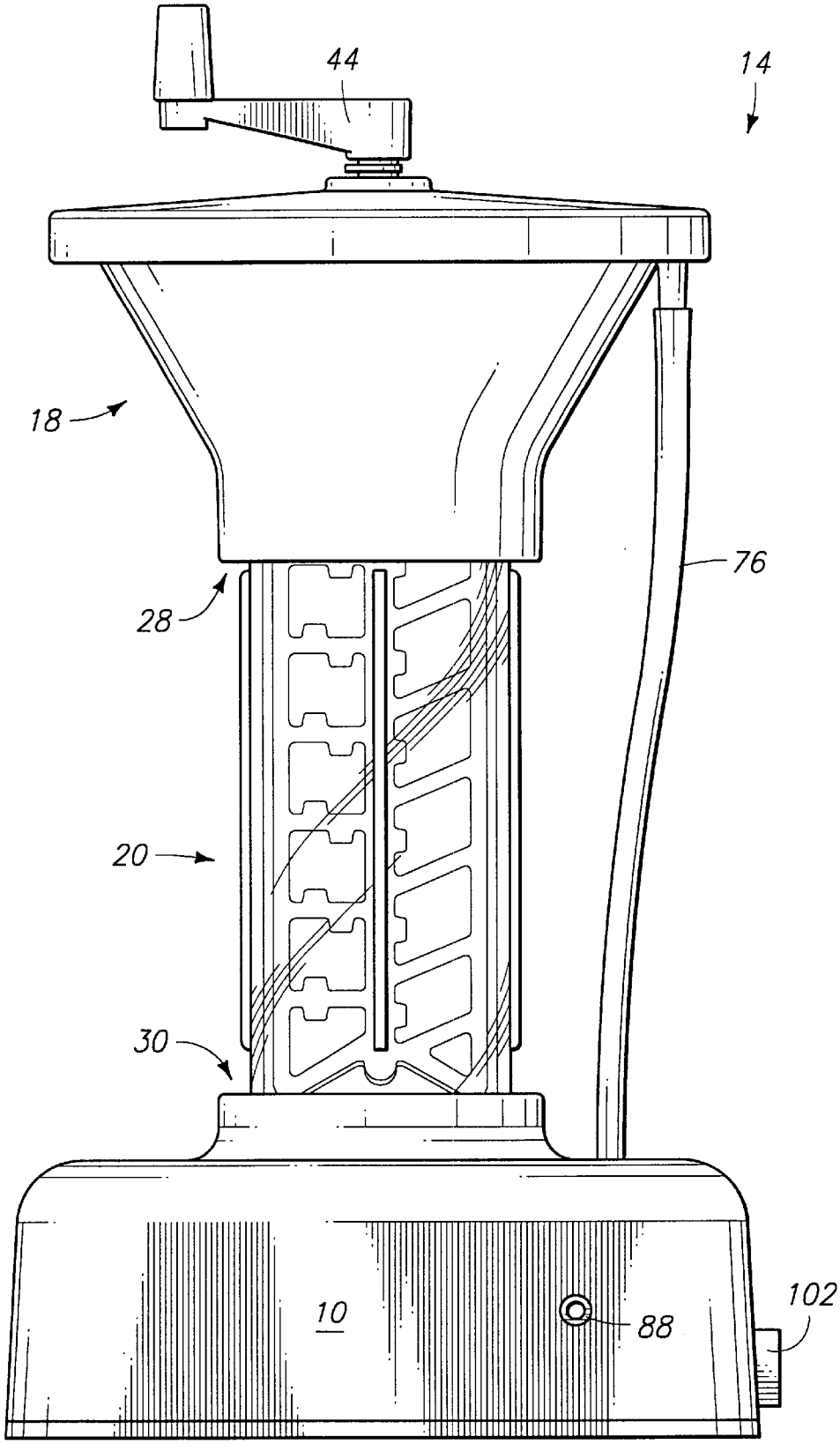
FIG. 2 is an assembled side view of the bone cement mixing apparatus of FIG. 1 showing the disposable base configured to support the mixing apparatus during a mixing operation.

As shown in FIG. 2, support base 10 is rigidly secured to the bottom of cartridge 20 via connector assembly 30, while funnel assembly 18 is rigidly secured to the top of cartridge 20 via connector assembly 28. In use, base 10 functions to support cartridge mixing apparatus 14 on a substantially flat, horizontal surface such as on a table top while filling apparatus 14 with ingredients, or components, of surgical bone cement, and while mixing such bone cement therein.

During mixing, a user will most likely grasp cartridge mixing apparatus 14 around cartridge 20 with one hand, pressing base 10 onto a support surface, while handle 44 is rotated with another hand. Base 10 functions to add stability to apparatus 14, while at the same time applying a vacuum inside of apparatus 14 via vacuum tube 76 and vacuum source 16 (see FIG. 3).

FIG. 3 illustrates in further detail via a vertical and centerline sectional view the assembly of the cartridge mixing apparatus 14 of FIGS. 1 and 2. In assembly, blade 64 terminates at a lowermost end of central shaft. 52 to form a nipple 112. Nipple 112 is received within a complementary receptacle 114 in piston 21, wherein receptacle 114 forms a bearing surface for nipple 112 of blade 64 during mixing of bone cement within cartridge 64.

Vacuum source 16 comprises a vacuum pump assembly 74 including vacuum pump 96, DC electric motor 100, power switch 84, and battery power supply 108. According to one construction, vacuum pump 96 is a sealed diaphragm vacuum pump designed to pull 20 to 23 inches of mercury at sea level. Also according to one construction, electric motor 100 is a 0.4 to 0.5 amp, 12-volt DC motor. Also according to such one construction, battery power supply 108 is a 12-volt battery pack. One suitable relatively low-cost vacuum pump 96 and electric motor 100 are constructed and sold together as a Model No. DP0140-A1111-X3-1661, sold by Medo U.S.A., Inc., 4525 Turnberry Drive, Hanover Park, Ill. 60103. However, it is understood that other vacuum pumps, electric motors, and power supplies can be utilized pursuant to Applicant's invention.

Accordingly, base 10 of FIGS. 1–3 forms a relatively low-cost, portable, and potentially disposable base for a bone cement mixing apparatus. The resulting base requires only a simple electrical switch, a battery power supply, a relatively low-cost diaphragm vacuum pump, and a relatively low-cost electric motor. The resulting vacuum source applies a relatively pre-set amount of vacuum, and the resulting vacuum is not adjustable. In contrast with prior art devices, there is no processing unit, memory, graphical user interface, or associated vacuum tubing that is required to be coupled with an external vacuum source. Accordingly, a simple, lightweight, disposable and portable vacuum base and mixing apparatus are provided in a construction that can be easily sterilized, hermetically sealed and pre-packaged for use in a surgical operating environment. In summary, a vacuum source is self-contained within the base so as to facilitate such beneficial features in a relatively low-cost and disposable manner.

According to one implementation, cartridge mixing apparatus 14 is sold as a pre-assembled and sterile unit, contained within a hermetically sealed package (not shown). Such package facilitates use within a sterile environment, such as within a sterile surgical operating room. Prior to use, a scrub nurse is merely required to open such package and remove cartridge mixing apparatus 14. Subsequently, individual ingredients, or components, of bone cement are inserted into cartridge 20 by first removing mixing blade assembly 36 (including cover 42 and mixing blade arm 48) from atop delivery funnel 40, and then pouring such ingredients into funnel 40 and cartridge 20.

Following such procedure, mixing blade assembly 36 is reinstalled atop delivery funnel 40 and the ingredients within cartridge 20 are hand-mixed by a user rotating handle 44 which imparts rotation of blade 64 within cartridge 20 sufficient to mix such components together.

However, before actual mixing begins, a user applies a vacuum inside cartridge mixing apparatus 14 by finger-engaging switch 102 to turn on vacuum source 16. More particularly, activation of switch 102 to an "on" position causes power to be applied to motor 100 from battery power supply 108 which then runs vacuum pump 96 so as to generate a vacuum inside vacuum tube 76. The application of a vacuum within mixing apparatus 14 is understood to reduce and/or eliminate the presence of air bubbles from within the resulting bone cement. The presence of such bubbles forms pores or voids within the cured bone cement that are undesirable, and that lead to weakening of such resulting cured cement.

As shown in FIG. 3, vacuum source 16 applies a vacuum when motor 100 drives vacuum pump 96 so as to impart a vacuum within vacuum tube 76. An in-line charcoal filter 106, interposed along vacuum tube 76, prevents the transfer of any fine particles of cement and vapors from delivery funnel 40 and into vacuum pump 96. Furthermore, in-line filter 106 prevents the release of cement vapors from exhaust vent tube 104 via vacuum pump 96. Preferably, in-line filter 106 comprises activated charcoal particles configured to allow air to pass through filter 106 while preventing the transfer of noxious vapors and particles therethrough.

Mixing of cement is then carried out manually via rotation of handle 44. After sufficient mixing has occurred, funnel assembly 18 is removed from cartridge 20 by decoupling connector assembly 18. Similarly, base 10 is removed from the other end of cartridge 20 by decoupling connector assembly 28. Cartridge 20, filled with mixed surgical bone cement, is then assembled into a cement gun, as described in Applicant's co-pending U.S. patent application Ser. No. 09/503,877, entitled "Connector Assembly for Mating Components, Connector Assembly for a Bone Cement Mixing and Delivery System, and Bone Cement Container Having a Connector Assembly", previously incorporated by reference.

Figure 4:
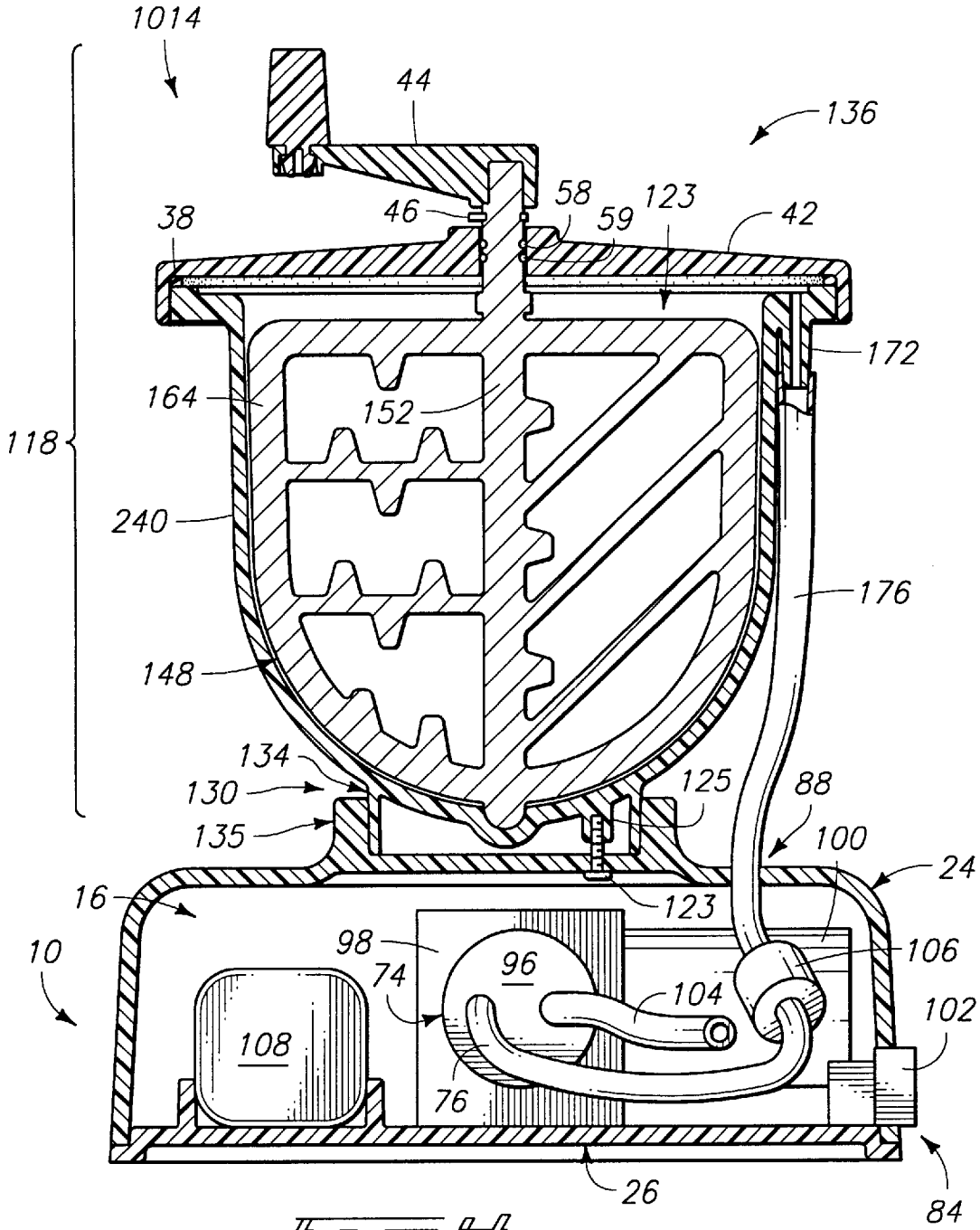
FIG. 4 is a vertical and centerline sectional view of a self-contained bone cement mixing system also using the disposable support base of FIGS. 1–3.

FIG. 4 illustrates support base 10 used in conjunction with an alternative embodiment cartridge mixing apparatus 1014. Mixing apparatus 1014 is shown as a pre-assembled mixing apparatus used for mixing bone cement for surgical applications such as when attaching an acetabular cup of a hip joint replacement system into a hip socket. In such applications, the bone cement delivery gun is not utilized. Instead, a user mixes ingredients of bone cement within mixing bowl 240 using mixing blade assembly 136. Accordingly, a mixing bowl assembly 118 is provided which is analogous to funnel assembly 18 (of FIG. 1). Additionally, mixing blade assembly 136 is analogous with mixing blade assembly 36 (of FIG. 1), with the only substantial difference being the difference in configuration for mixing blade 164 and central shaft 52 of mixing blade arm 148, when compared with blade 64, shaft 52 and mixing blade arm 48 (in the embodiment of FIG. 1).

As was the case with the embodiment depicted in FIGS. 1–3, mixing blade assembly 136, including cover 42, is removed from mixing bowl 240, after which bone cement ingredients are introduced into bowl 240. Subsequently, mixing blade assembly 36, including cover 42, is fitted atop bowl 240 where a seal is formed by closed-cell foam gasket 38. Thereafter, vacuum source 16 applies a vacuum via vacuum pump 96 of vacuum pump assembly 74 and vacuum tube 176 during mixing therein. Vacuum tube 176 communicates with mixing chamber 123 of mixing bowl 240 by way of vacuum port 172. It is understood that vacuum port 172 (as well as vacuum port 72 of FIG. 1) communicates at a location radially inward of gasket 38 so as to impart a vacuum within mixing chamber 123.

Furthermore, according to one construction, mixing bowl 240 is permanently affixed to base 10 via connector assembly 130. More particularly, connector assembly 130 is formed by connectors 137 and 139, which are configured to fit together in mating engagement therebetween. Furthermore, a pair of threaded fasteners 123 are used to permanently affix mixing bowl 240 atop base 10 for applications where mixing apparatus 1014 is sold as a self-contained hermetically sealed mixing apparatus. A pair of threaded fasteners 123 are each received within a boss 125 of bowl 240 having a threaded aperture therein. Optionally, threaded fasteners 123 and bosses 125 are not utilized, and a connector assembly similar to connector assembly 30 and having connectors 34 and 35 can be substituted for connector assembly 130. Further optionally, base 10 and bowl 240 can be integrally formed from a single piece of material.

It is understood that support base 10 of FIG. 4 is identical to support base 10 of FIGS. 1–3, save for vacuum tube 176 being slightly foreshortened over vacuum tube 76 (of FIG. 3).

As shown in the embodiments depicted in FIGS. 1–4 above, a support base is provided for a mixing system for binding materials such as adhesives and cements. The support base includes a support member and a vacuum source. The support member is configured to support an adhesive, or cement, within a mixing chamber. The vacuum source is carried by the support member, and is operative to impart a relative vacuum within the mixing container during mixing of the cement, or adhesive. In one application, the cement, or adhesive, is a surgical bone cement that is formed from a plurality of ingredients, or components.

According to one construction, the support member includes a housing, with the vacuum source being provided within the housing. More particularly, the housing in one construction includes a housing member and a base plate that is affixed to the housing member. As such, the vacuum source includes a vacuum pump which is also self-contained within the housing.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A bone cement mixing system comprising, a base comprised of a support surface on a housing that encloses a vacuum source comprised of a vacuum pump, a motor to drive the vacuum pump and a battery to power the motor, the vacuum source being configured to draw a vacuum within a vacuum chamber;

a mixing container comprising a removable top, a bottom and a cylindrical wall that encloses an interior volume that defines the vacuum chamber and mixing surfaces for the bone cement, the interior volume being in operable communication with the vacuum source through a port, and the removable top further including an attached mixing blade assembly fastened to the top that includes agitator blades disposed within the interior volume, a first connector assembly coupling the bottom of the mixing container to the support surface of the base, and a top sealing assembly removably sealing the top with attached mixing blades onto the mixing container.

2. The bone cement mixing system of claim 1 wherein the vacuum source comprises a single non variable vacuum pump configured to draw a preset non-adjustable vacuum within the vacuum chamber.

3. The bone cement mixing system of claim 1 further including a funnel assembly interposed between the removable top and the cylindrical walls of the mixing container.

4. The bone cement mixing system of claim 3 wherein the funnel assembly contains the port in operable communication with the vacuum source.

5. The bone cement mixing system of claim 4 further including a second connector assembly that removably couples the funnel assembly to the mixing container.

6. The bone cement mixing system of claim 5 wherein the second connector assembly includes a first set of mating connectors on the funnel assembly that engage a second set of complementary mating connectors on the mixing container.

7. The bone cement mixing system of claim 6 wherein the second set of mating connectors are also configured to engage a third set of mating connectors on a nozzle assembly so that the nozzle assembly can be coupled to the top of the mixing container to receive cement therefrom.

8. The bone cement mixing system of claim 1 wherein the cylindrical walls and bottom of the mixing container are configured as a cement gun delivery cartridge.

9. The bone cement mixing system of claim 8 wherein the delivery cartridge includes a moveable piston initially positioned toward the bottom of the mixing container in sealing engagement with the cylindrical walls thereof and configured to urge mixed cement upward in the cartridge by upward movement of the piston.

10. The bone cement mixing system of claim 1 wherein the first connector assembly removably couples the mixing container to the base.

11. The bone cement mixing system of claim 10 wherein the first connector assembly includes a first set of mating connectors on the base that engage a second set of complementary mating connectors on the mixing container.

12. The bone cement mixing system of claim 11 wherein the second set of complementary mating connectors are also configured to engage a third set of complimentary mating connectors on a cement delivery gun so that the bottom of the mixing container can be coupled to the delivery gun to deliver the cement from the mixing container.

13. The bone cement mixing system of claim 1 wherein the first connector assembly fixedly couples the mixing container to the base.

14. The bone cement mixing system of claim 1 wherein the port is connected to the vacuum source by a vacuum hose located exterior to the mixing container and the base.

15. The bone cement mixing system of claim 1 wherein the base and the mixing container are assembled as a self-contained unit, sterilized and packaged in a hermetically sealed package.

16. The bone cement mixing system of claim 1 wherein the mixing blade assembly includes a manually operated crank.

17. The bone cement mixing system of claim 1 wherein electrical control of the system consists essentially of a switch to interconnect the battery with the motor.

18. The bone cement mixing system of claim 1 wherein the vacuum source delivers a vacuum of 20–23 inches of mercury at sea level.

19. The bone cement mixing system of claim 1 wherein the motor is a 12 volt, 0.4 to 0.5 amp DC motor.

20. The bone cement mixing system of claim 1 wherein a filter is interposed between the port and the vacuum source to absorb particulate matter and fumes.

21. The bone cement mixing system of claim 20 wherein the housing includes a vent aperture operative to exhaust gasses from the mixing container to outside the housing.

22. A bone cement mixing system comprising, a base comprised of a support surface on a housing that encloses a vacuum source comprised of a single non variable vacuum pump, a motor to drive the vacuum pump and a battery to power the motor, the vacuum source being configured to draw a preset non-adjustable vacuum within a vacuum chamber;

a mixing container comprising a removable top with an attached mixing blade assembly fastened to the top that includes agitator blades for mixing the bone cement, a bottom, and a cylindrical wall that together enclose an interior volume that defines the vacuum chamber and mixing surfaces for the bone cement, the agitator blades being disposed within the interior volume and the interior volume being in operable communication with the vacuum source through a port, the mixing container further having a moveable piston disposed therein in sealing engagement with the cylindrical walls, a first connector assembly removably coupling the bottom of the mixing container to the support surface of the base, and a top sealing assembly removably sealing the top with attached mixing blade assembly onto an upper portion of a removable funnel assembly that contains the port in operable communication with the vacuum source; and a second connector assembly removably coupling a bottom portion of the funnel assembly to an upper portion of the cylindrical walls of the mixing container.

23. The bone cement mixing system of claim 22 wherein the mixing container comprises a cement gun mixing cartridge;

the first connector assembly includes a first set of mating connectors on a lower portion of the cartridge that engage a complimentary set of mating connectors on the base; the first set of mating connectors also being configured to engage a complementary set of mating connectors on a bone cement delivery gun so that the cement can be urged from the mixing cartridge by upward movement of the piston by the delivery gun; and the second connector assembly include a second set of mating connectors on an upper portion of the cartridge that engage a complimentary set of mating connectors on the funnel, the second set of mating connectors also being configured to engage a nozzle assembly so that the nozzle assembly can be mated with the cartridge to deliver the cement from the cartridge.

24. The bone cement mixing system of claim 23 wherein the base and the cartridge are assembled as a self-contained unit sterilized and packaged in a hermetically sealed package.

25. The bone cement mixing system of claim 22 wherein the port is coupled to the vacuum source by a vacuum hose located exterior to the mixing container and the base.

26. The bone cement mixing system of claim 22 wherein the base and the mixing container are assembled as a self-contained unit, sterilized and packaged in a hermetically sealed package.

27. The bone cement mixing system of claim 22 wherein the mixing blade assembly includes a manually operated crank.

28. The bone cement mixing system of claim 22 wherein electrical control of the system consists essentially of a switch to interconnect the battery with the motor.

29. The bone cement mixing system of claim 22 wherein the vacuum source delivers a vacuum of 20–23 inches of mercury at sea level.

30. The bone cement mixing system of claim 22 wherein the motor is a 12 volt, 0.4 to 0.5 amp DC motor.

31. The bone cement mixing system of claim 22 wherein a filter is interposed between the port and the vacuum source to absorb particulate matter and fumes.

32. A bone cement mixing system comprising, a base including a support surface on a housing that encloses a vacuum source consisting essentially of a single, non variable vacuum pump, a motor to drive the vacuum pump a battery to power the motor and a switch to interconnect the battery and the motor, the vacuum source being configured to draw a preset non-adjustable vacuum within a vacuum chamber;

a mixing container consisting essentially of a removable top, a bottom and a cylindrical wall that encloses an interior volume that defines the vacuum chamber and mixing surfaces for the bone cement, the interior volume being in operable communication with the vacuum source through a port, the port being located in a funnel assembly interposed between the top and the cylindrical wall, the port being connected to the vacuum source by a vacuum hose located exterior to the mixing container and the base, and the removable top further including an attached mixing blade assembly fastened to the top that includes agitator blades disposed within the interior volume and a hand crank for mixing the cement, a first connector assembly coupling the bottom of the mixing container to the support surface of the base, and a top sealing assembly removably sealing the top with attached mixing blade assembly onto the mixing container.

33. The bone cement mixing system of claim 32 wherein the base and the mixing container are assembled as a self-contained unit, sterilized and packaged in a hermetically scaled package.

* * * * *